United States Patent [19]

Wuepper et al.

[11] Patent Number: 4,791,975

[45] Date of Patent: Dec. 20, 1988

[54] PROCESS OF FLASKLESS SAND CASTING

[75] Inventors: Thomas E. Wuepper, Alger; Terry L. Franklyn, Nunica, both of Mich.

[73] Assignee: CMI International, Inc., Southfield, Mich.

[21] Appl. No.: 28,122

[22] Filed: Mar. 19, 1987

[51] Int. Cl.[4] ..... B22C 9/02; B22C 21/02

[52] U.S. Cl. ..... 164/29; 164/392

[58] Field of Search ..... 164/29, 322, 323, 377, 164/382, 393

[56] References Cited

U.S. PATENT DOCUMENTS

| | | | |
|---|---|---|---|
| 1,074,006 | 9/1913 | Mott, Jr. | 164/29 |
| 2,867,870 | 1/1959 | Hines | 164/29 |
| 3,695,338 | 10/1972 | Masi | 164/29 |

*Primary Examiner*—Nicholas P. Godici
*Assistant Examiner*—J. Reed Batten, Jr.
*Attorney, Agent, or Firm*—Cullen, Sloman, Cantor, Grauer, Scott and Rutherford

[57] ABSTRACT

A relatively hard sand cake, containing a metal casting cavity, is formed in a flask comprising cope and drag frame sections by filling and compacting sand in the drag against the drag half of a cavity-forming pattern, then arranging the drag with the cavity opening upwards, applying the cope upon the drag and filling and compacting sand in the cope against the cope half of the cavity-forming pattern. The sand-filled cope is lifted from the drag for removal of the pattern and is reapplied to form the casting cavity in the sand cake. Next, selected wall corner joints of both the cope and the drag frames are separated and opened to laterally expand the walls of the frames away from the sand cake surfaces. This releases the sand cake from the cope and drag so that it may be removed from the flask for later casting molten metal in its casting cavity. At least two of the corners of each of the cope and drag frames include a separate corner piece against which the adjacent ends of the frame walls are abutted. A releasable fastening mechanism secures the corner pieces to their adjacent frame walls and may be selectively operated to separate the corner pieces from their adjacent walls for opening the wall corner joints.

4 Claims, 3 Drawing Sheets

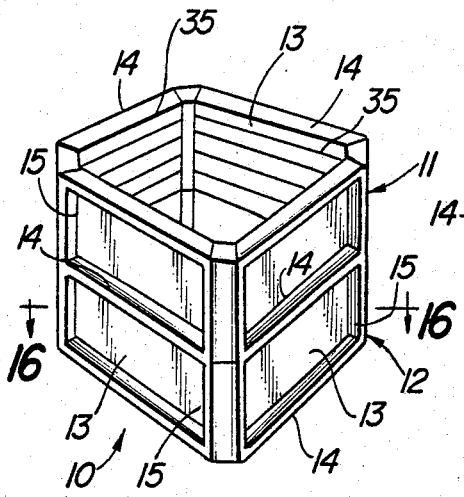
Fig-13
Fig-14
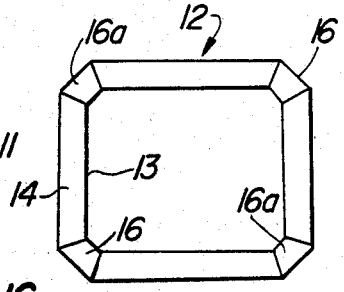
Fig-15
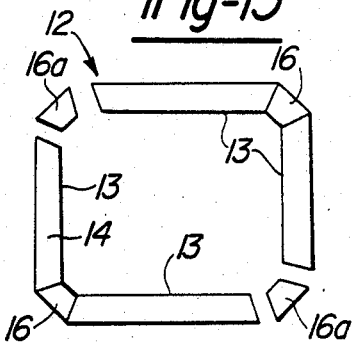
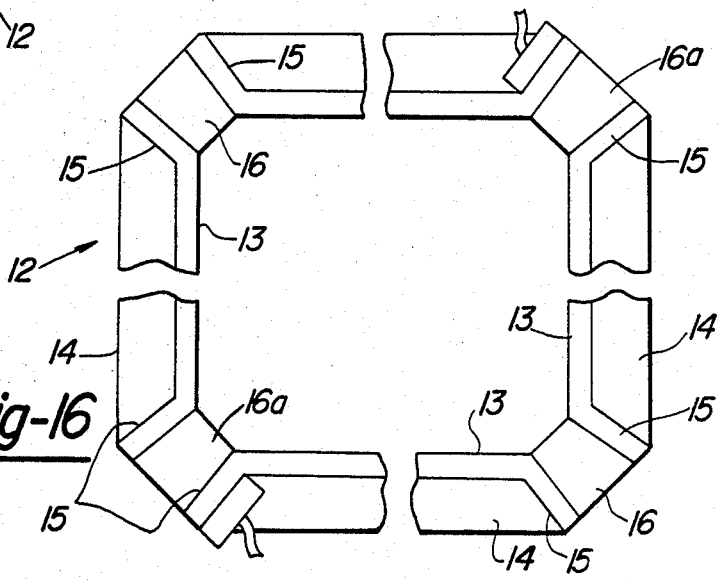
Fig-16
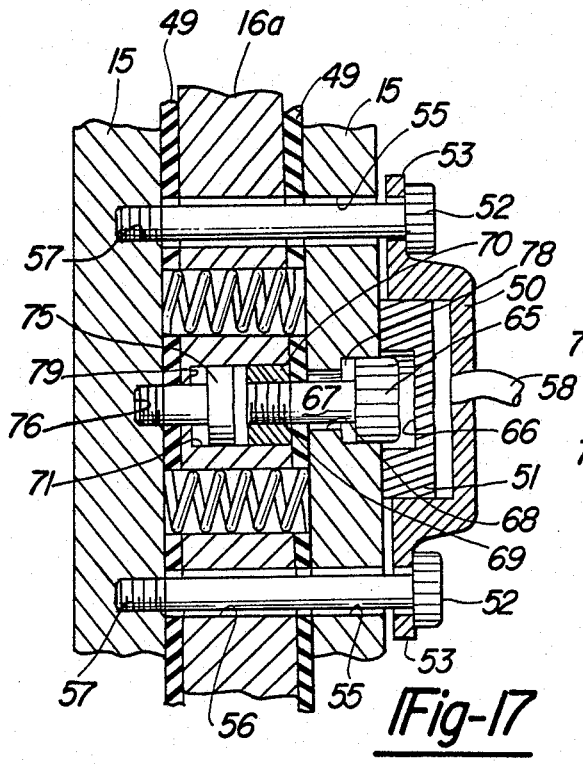
Fig-17
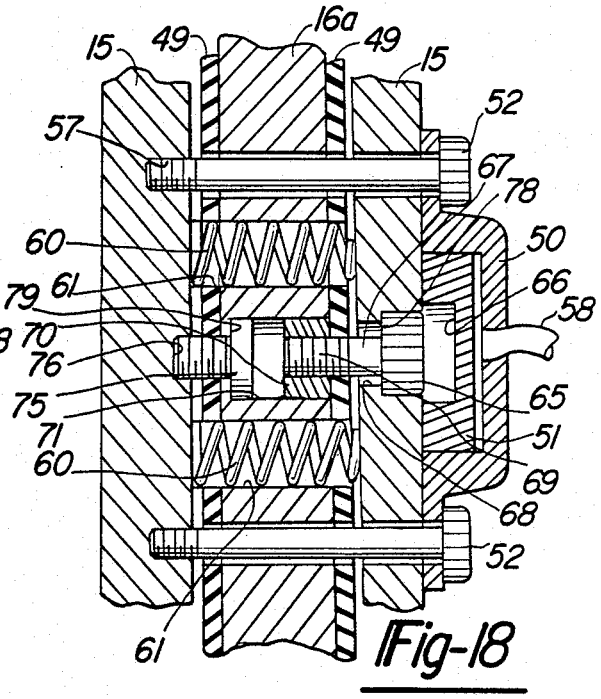
Fig-18

PROCESS OF FLASKLESS SAND CASTING

BACKGROUND OF THE INVENTION

This invention relates to an improved method and flask for producing a sand cake mold used in molten metal, flaskless sand casting procedures. By way of background, a well-known and widely used sand casting procedure involves the use of a flask which consists of a lower, drag frame section and an upper, cope frame section. The sections are packed with sand, around a pattern, to form a cavity into which molten metal is poured for solidification into a cast object.

Commonly, the cavity in the sand is formed by first positioning a solid, pattern half within the drag and then filling the drag with sand that is compacted around the pattern half. Next, the drag is inverted and the cope is mounted upon it. A cope pattern half is positioned inside of the flask, upon the drag pattern half, and the cope is filled with compacted sand. Then, the cope is removed from the drag, and the pattern is removed from both the cope and the drag to form the cavity. Repositioning the cope upon the drag forms the complete cavity into which the molten metal is to be poured.

During the time that the cavity is formed, suitable pouring passages or sprues, gates and risers are formed in the sand for the flow of metal into the cavity. Of course, more than one cavity may be formed at a time, depending upon the casting requirements, sizes, etc.

In this system of casting, after the metal solidifies, the cope and drag sections of the flask are removed, the and is broken away from the solidified metal part and the cast metal part is complete.

In recent times, for production casting of large numbers of similar parts at increased volume and reduced labor, flaskless sand casting has been used. This involves, essentially, the same procedures as mentioned above, except that after the cavity is formed in the sand, within the flask, the sand "cake", i.e. the compacted sand block which contains the cavity and is located within the flask, is removed from the flask. The flask may be reused to form another sand "cake". Meanwhile, the flaskless cake proceeds to the casting area and molten metal is poured into it.

In many cases, the flaskless sand "cake" has sufficient structural integrity to receive molten metal and to permit solidification of the molten metal within it. In those cases where the hydrostatic pressures are too great for the flaskless sand "cake", a reinforcing jacket is positioned around the cake and a weighted cover plate may be placed upon the top of it to prevent the sand from breaking or to prevent the molten metal from bursting out through the sand.

In the flaskless type of operation, the flask and the pattern may be handled within an automatic machine which rapidly positions the cope and drag fills and compacts the sand and permits removal of the completed sand cake rapidly, with minimal hand labor.

After the sand is compacted within the flask, the cope section may be opened and immediately removed. The cope may be opened by disconnecting some of the corners which make up the four sided cope frame by separating the frame walls at the corners. Thereafter, the and cake may be pushed downwardly through the drag or, conversely, the drag pulled upwardly over the cake. Because the sand is compacted within the drag frame, it frequently is damaged in the separation of the drag from the cake due to the frictional drag and the sticking of the sand to the walls. However, it has been believed to be necessary to leave the drag in place around the bottom of the cake while the cope is removed, in order to protect the integrity of the cake and to prevent its damage during the removal of the cope. Hence, little has been done to prevent the drag-caused damage in the past.

Thus, the invention herein contemplates loosening or separating the drag from the sand cake before the cake is removed from the drag and also, a simplified system for loosening the drag. Moreover, the invention contemplates compacting the sand within the flask to a much greater degree than has been done in the past so that the cake is much harder or denser than prior cakes. This is possible because of the improved drag arrangement.

SUMMARY OF THE INVENTION

This invention relates to forming a sand "cake" within a flask, having cope and drag frame sections, with one or more casting cavities formed within the cake for the casting of molten metal therein. The procedure for forming the cake, similar to past practices, involves first, packing sand into the drag around the drag pattern half, inverting the drag and positioning the cope upon it, packing sand into the cope around the cope pattern half, separating the cope from the drag to remove the casting pattern, and then replacing the cope upon the drag to provide the sand casting cavity within the compacted sand. Thereafter, the sand "cake" is removed from the flask by first opening the cope. However, the invention contemplates, first, compacting the sand until it forms a relatively hard sand "cake", and, second, separating the drag from the cake before the cake is moved downwardly for removal from the flask.

The four walled drag is formed with opposed corner pieces to which the adjacent ends of the drag frame walls are connected. A connecting mechanism is provided which, when operated in one direction, clamps the wall ends against the corner pieces for abutting them together tightly for receiving the sand. When operated in the opposite direction, the mechanism forces the corner pieces and their adjacent wall ends apart a small amount. The amount, while small, as for example in the range of roughly 0.030 of an inch in a typical operation, is enough to relieve the pressure between the sand filling and the walls of the drag and to release the frictional forces so that the sand cake may be easily moved downwardly, relative to the drag for removal.

The mechanism for separating and for clamping together the adjacent wall ends and corner pieces includes a piston arranged within a powered cylinder mounted upon one wall portion adjacent a corner piece. The piston extends through the corner piece to contact the opposite wall portion. Upon the application of fluid power, the piston wall move and cause the two adjacent wall portions to abut and clamp against the corner piece located between them. Conversely, upon deactivation of the piston, heavy springs separate the opposite wall portions from the corner piece located between them.

Another form of connecting and separating mechanism, which may be provided for the cope, includes a powered piston means which, when operated in one direction, clamps adjacent wall portions to the corner piece between them and, conversely, when operated in the opposite direction, separates them.

The mechanisms described above laterally expand the cope or drag frames, because they move the opposed walls apart a slight amount. This relieves the hoop-like pressure of the walls against the sand cake formed within them. Because the sand may be compacted to a greater degree and may be more dense or harder than in the past, the cake may be removed from both the cope and drag at the same time without damage to the cake.

One of the objects of this invention is to provide a system for rapidly forming high quality hard, sand casting cakes, with minimal labor and without damage caused during the cake manufacturing procedure.

A further object of this invention is to provide a system by which sand casting cakes can be rapidly made in a flask by opening and laterally expanding the flask drag section away from the formed cake.

Still another object is to enable the manufacture of a much harder and denser sand cake than was practical in the past. To a considerable extent, this is made possible by the step of laterally separating or opening the drag after the formation of the cake so that it is possible to initially compress the sand tighter within the drag and to relieve the pressure between the cake and drag wall surfaces for removal of the cake from the drag.

These and other objects and advantages of this invention will become apparent upon reading the following description, of which the attached drawings form a part.

DESCRIPTION OF DRAWINGS

FIG. 13 is a perspective view of a typical flask used in making the sand mold.

FIG. 14 is a schematic, top view of the drag in closed or use condition.

FIG. 15 is a view similar to FIG. 14, but illustrating the drag in its open or laterally expanded condition.

FIG. 16 is an enlarged, fragmentary, cross-sectional plan view of the drag taken in the direction of arrows 16—16 of FIG. 13.

FIG. 17 is an enlarged, cross-sectional view of the drag corner opening and closing mechanism shown in closed condition.

FIG. 18 is a view similar to FIG. 17, but showing the mechanism in open condition.

DETAILED DESCRIPTION

Figure 1:
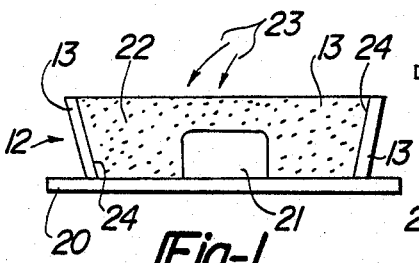
FIGS. 1–10, inclusive, schematically illustrate the successive steps in forming the sand cake mold.
Figure 2:
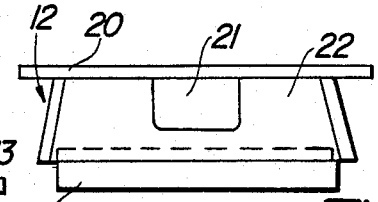

FIG. 13 illustrates a flask 10 comprising an upper, cope frame section 11 resting upon a lower, drag section 12. Each of the frame sections are made of four walls 13 having upper and lower frame flanges 14 and angularly bent side frame flanges 15 (see FIG. 16).

The ends of adjacent walls are fastened together by fastening their side frame flanges 15 to corner pieces which form the frame corners. Four corner pieces are provided, each fastened to its adjacent side frame flanges 15. Two opposed corner pieces 16 are rigidly connected to their adjacent flanges 15, such as by bolts or by welding. The other two, opposite corner pieces **16*a* are movably or separably connected to their adjacent panel side frame flanges 15**.

A closing and opening mechanism is provided for selectively abutting or separating the movable corner pieces and their adjacent wall flanges. The mechanism, illustrated in FIGS. 17 and 18, will be described later. FIG. 14 shows the drag with the four walls and corner pieces in closed position, that is, in the position where the panel flanges 15 abut their adjacent corner pieces 16 and **16*a*. FIG. 15 shows two of the corner pieces 16*a* separated from their adjacent wall edges, that is, separated from the panel flanges 15. In the condition shown in FIG. 14, the drag is ready for use in forming a sand mold. In the condition shown in FIG. 15**, the drag is laterally expanded to release its grip and pressure upon the sand contained therein so as to permit removal of the sand cake.

The steps in the method for forming the sand mold or "cake" are schematically illustrated, in sequence, in FIGS. 1–10. The first step, (see FIG. 1) involves placing the drag 12, upside down, upon a support or match board 20. A drag pattern section or "half" 21 is positioned upon the match plate. One or more of such patterns may be used, depending upon the number of cavities to be prepared at one time. Typically, the pattern section or "half" is fastened upon the match plate so that the two are handled as one unit.

Foundry mold-forming sand 22 is poured into the upsidedown drag, as illustrated by the filling arrow 23 (see FIG. 1) until the drag is filled. The sand filling may be compressed into place, using a suitable ram or the like.

As shown in exaggerated form in the schematic drawing of FIG. 1, the inner wall surfaces 24 of the wall-forming panels 13 of the drag are sloped. Likewise, the cope inner wall surfaces are sloped. The actual slope is only a small amount and is angled inwardly from the bottom of the drag to the top of the cope, as will be seen in the schematic sketches illustrating the assembled cope and drag (e.g. see FIGS. 3 and 7).

After sand filling the drag, a cover board 25 is placed upon the upper surface of the sand filling. Next, the drag is inverted, that is, turned right-side up, with the cover board 25 now being at the bottom opening of the drag frame section and the match plate 20 being upon the upper surface (see FIG. 2). The cover board prevents the sand filling from falling out of the drag during the time that the drag is turned over and repositioned.

Figure 3:
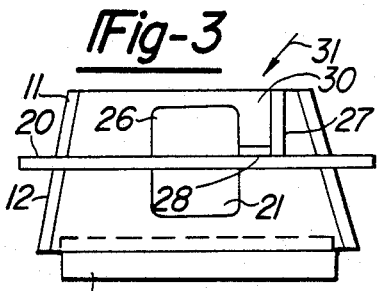

FIG. 3 illustrates the next step wherein the cope frame section 11 is positioned upon the match plate and drag. The cope pattern section or "half" 26 is applied if it is a separate element. In some cases, the match plate may carry both the cope and drag pattern halves so that the cope pattern half is automatically in position as shown in FIG. 3. In addition, a sprue forming pin 27 and gate and runner forms 28 are positioned within the cope to facilitate the formation of the interior passageways through which the molten metal will flow to the cavity within the mold. The particular form and shape of the sprue pin and the gate and runner forms may vary depending upon the casting needs and, therefore, it is shown schematically in the drawings.

Next, sand 30 is filled into the cope, as indicated by the sand filling arrow 31 shown in FIG. 3. The sand may be compacted with a suitable ram or the like.

Figure 4:
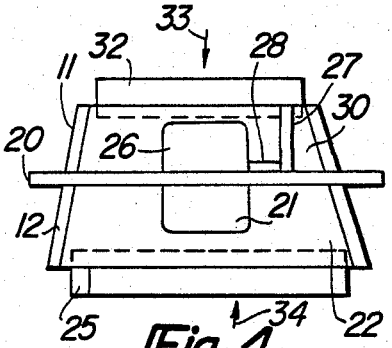

As shown in FIG. 4, a platen 32 is applied against the upper surface of the sand filling 30 in the cope. A force, indicated by arrow 33, is applied against the platen 32. The force may be applied by a suitable piston or the like. Simultaneously, an upwardly-directed force, indicated by the arrow 34, is applied against the cover board 25 which is located at the open bottom end of the drag. Thus, the cover board and the platen are squeezed towards each other to apply considerable pressure which compresses the sand filling. It is intended that the pressure, and consequently the amount of compacting of the sand, are considerably more than the normal amount. The exact amount of compression is a matter of determination by one skilled in the art by trial and error based upon the casting job involved. However, by over-compacting the mass of sand, a hard sand cake is formed. In prior mold forming procedures, over-compacting the sand was not feasible because of the difficulty of removing the finished cake from the mold without breaking or damaging it.

Sometimes, a cope may be provided with interior grooves on the interior surface of its walls or panels. These grooves 35 receive sand pushed into the grooves during the compression or ramming step during the filling of the cope (see FIG. 13). If such grooves are used, the sand cake walls of the cope section will have integral ridges or embossed lines corresponding to the grooves 35.

Figure 5:
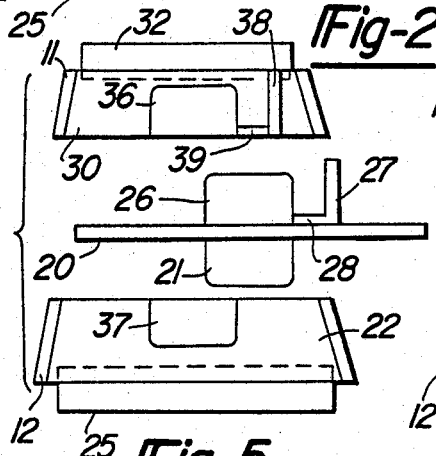

After the sand cake is compressed, the cope section is separated from the drag section, as by lifting it upwardly (see FIG. 5). The match plate 20 with the upper and lower pattern halves 26 and 21 and the sprue forming pin 27 and gate-runner forms 28 are removed, leaving a cope cavity half 36, a drag cavity half 37 and a sprue 38 with gate-runner formations 39.

Figure 6:
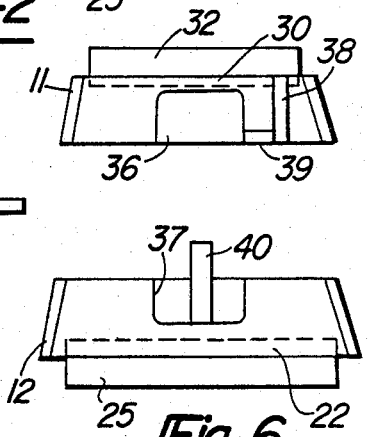
Figure 7:
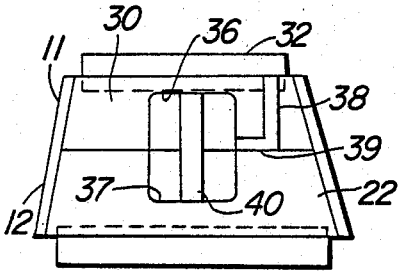

Next, where desired, a core 40 may be positioned within the cavities (see FIG. 6). Likewise, any other desired inserts may be positioned in the cavities. Then, the cope is re-positioned upon the drag (see FIG. 7) to form the complete cavity within the sand cake made of the cope and drag sand fillings engaged together.

Figure 8:
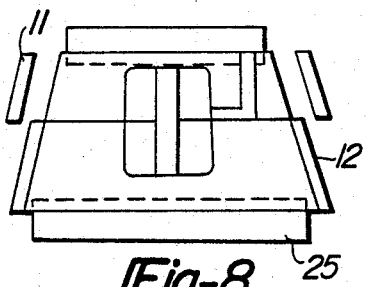
Figure 19:
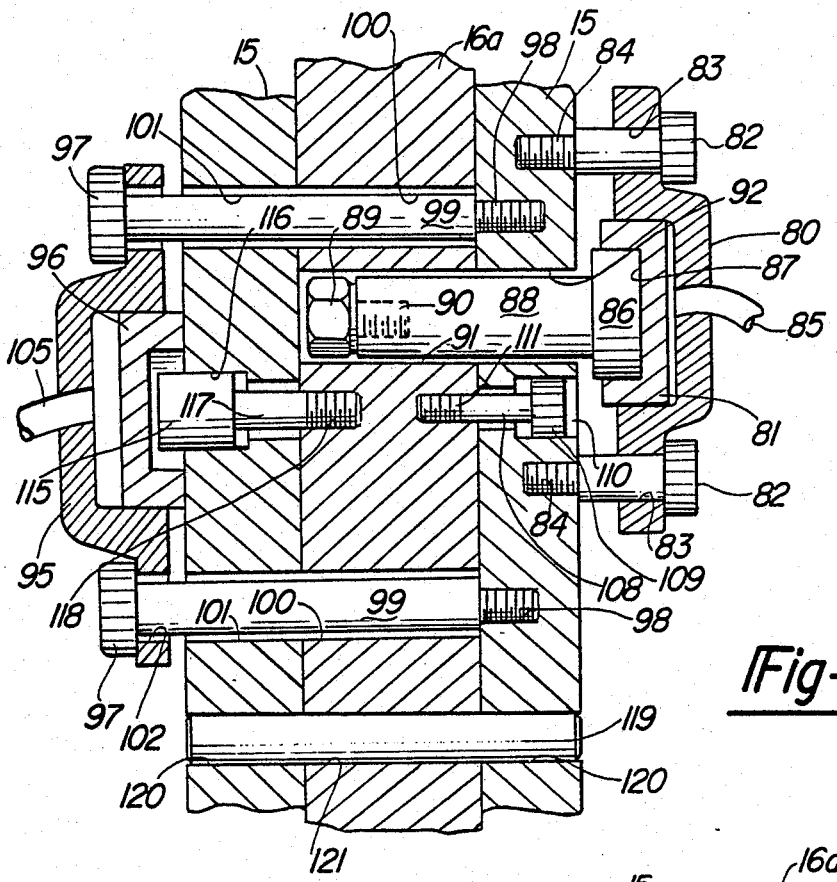
FIG. 19 is an enlarged, fragmentary cross-sectional view of the cope corner opening and closing mechanism shown in the closed condition.
Figure 20:
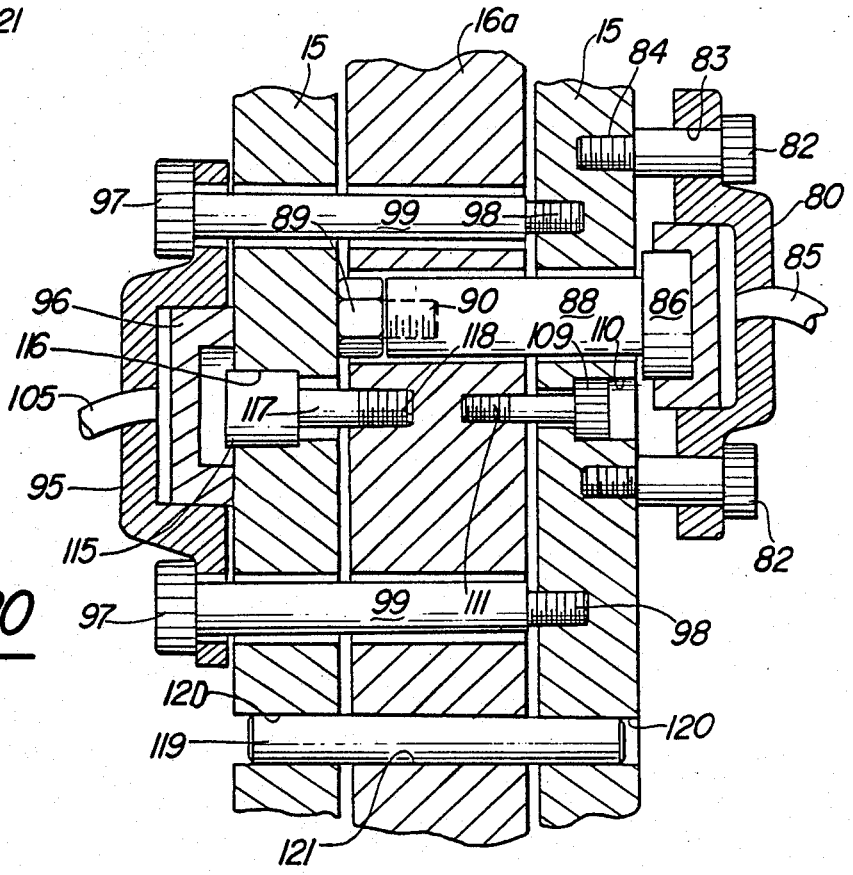
FIG. 20 is a view similar to FIG. 19, but showing the cope corner opening and closing mechanism in its open condition.

FIG. 8 illustrates the next step of removing the cope frame section from the sand cake. This may be accomplished by forming a cope with wall sections that are fastened together by releasable fasteners. The fasteners may be operated to disengage one or more of the corners of the cope so that it may be peeled away from the sand cake. Alternatively, the walls of the cope may be separated or spread apart at the corners. Thus, by expanding the cope laterally relative to the cake, the cake is no longer gripped against the cope and the two may be separated. For the purpose of expanding the cope, that is, separating the walls of the cope, a cope opening and closing mechanism is provided. This is illustrated in FIGS. 19 and 20 and will be described later.

Figure 9:
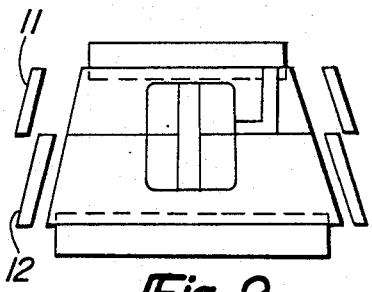
Figure 10:
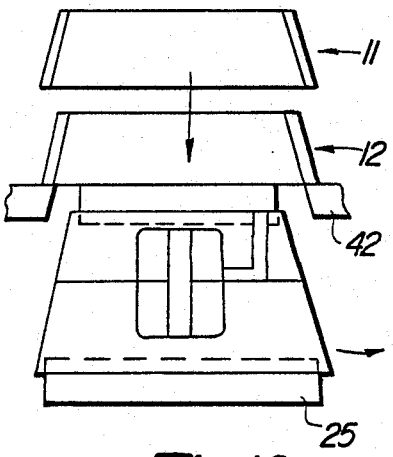

FIG. 9 shows the drag expanded laterally relative to the cake. In this instance, the walls forming the drag frame section are separated, by separating the wall ends from the corner pieces 16*a* (see FIG. 15), to release the drag from the sand cake. By laterally expanding the drag, that is, by moving its walls laterally only a small distance, as for example, 0.030 inches, the pressure between the sand cake and the interior wall surfaces of the walls of the drag are relieved and the cake may be moved relative to the drag.

Finally, the sand cake is removed from the drag (see FIG. 10) by moving it downwardly relative to the expanded or spread apart cope and drag. For this purpose, the cope and drag may be rested upon a support table 42 and the cover board may be rested upon a suitable platform which moves downwardly (not illustrated). Thereafter, the sand cake, without the flask, may be moved horizontally away from the flask, as indicated by the arrows in FIG. 10.

Figure 11:
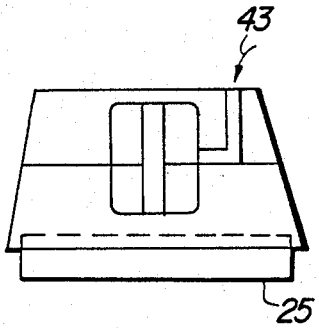
FIG. 11 is a schematic drawing illustrating casting molten metal into the sand mold.

Once the sand cake is completed, it is self-sustaining, as illustrated in FIG. 11. The platen or cover on the upper surface may be removed. Now, molten metal may be poured into the sprue (see arrow 43, FIG. 11) and the metal will flow through the gate and runner network into the interior cavity, around the core, and form the cast part.

Figure 12:
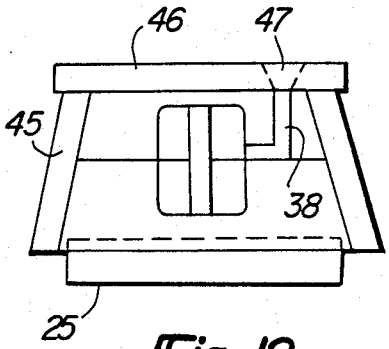
FIG. 12 is a view similar to FIG. 11 but schematically illustrates reinforcing the flaskless sand mold with an exterior jacket and cover plate.

In some instances, where the hydrostatic pressure is too great for the sand cake, the sand cake may be reinforced by an exterior jacket 45 and by an upper, cover plate 46. These will brace and hold the cake against bursting or breaking under the hydrostatic pressure. In order to pour the molten metal into the sprue, a suitable opening 47 may be formed in the plate 46 (see FIG. 12).

The drag opening and closing mechanism is illustrated in FIGS. 17 and 18. FIG. 17 illustrates the mechanism in the closed position where the corner pieces 16*a* are abutted, in tight engagement, against the vertical edge portions of the walls, that is, the vertical wall flanges 15. The corner piece surfaces and the wall edge or flange surfaces of the flanges 15 may be directly abutted or, alternatively, suitable gaskets 49 may be arranged between the engaged surface. For purposes of illustration, gaskets made of a suitable synthetic rubber-like material are illustrated in FIG. 17, with the thicknesses thereof being considerably exaggerated.

A flat, pancake-type cylinder 50, containing a movable piston 51 is positioned upon one of the side frame edges 15. The cylinder is fastened in place by means of long bolts 52 that extend loosely through holes 53 in lugs or extensions that are part of the cylinder. The bolts also loosely extend through holes 55 in the frame flange upon which the cylinder is mounted, and through holes 56 in the corner piece 16*a*. The threaded ends of the bolts are threadedly engaged in threaded sockets 57 formed in the opposite side frame flange.

In the condition shown in FIG. 17, pressurized fluid, such as compressed air or pressurized hydraulic fluid, enters the cylinder through a delivery tube 58 and causes the flat piston 51 to press against the adjacent wall portion of the flange 15. This causes the cylinder to move slightly away from the wall, thereby pulling the bolts 52 towards the wall upon which the cylinder is mounted. Hence, the two adjacent wall frame flanges 15 are squeezed towards each other and against the corner piece 16*a* or, more accurately, against the gaskets 49 on the corner piece 16*a*, by the squeezing piston and the pull on the bolts. This keeps the drag in closed condition where the corner pieces are all tightly butted against the adjacent wall portions of the section.

The opening and closing mechanism is shown in open condition in FIG. 18. There, the force of the hydraulic fluid or compressed air is discontinued. Compression springs 60, which are arranged between the two flanges 15 and within openings 61 in the corner piece 16*a*, resiliently bias the adjacent wall flanges 15 apart to separate the walls of the drag laterally. The amount of separation may be small, as for example, roughly 0.030 inches for each separation. The exact amount of separation must be determined depending upon the particular requirements, such as the nature and size of the flask and of the cake, etc.

To limit the movement of the flanges 15 relative to the corner pieces, separate limit means are provided for each flange. One limit means comprises a bolt-like element having a head 65 loosely fitted into a socket 66 in the piston 51. The head 65 and stem 67 extend loosely through a counterbored opening 68 in the flange 15. The stem terminates in a threaded connection 69 formed in a threaded insert 70 arranged within an opening 71 within the corner piece 16*a*. The head 65 is spaced a short distance from the annular base of the counterbore of the opening 68.

Similarly, a bolt-like element having a head 75, which is fitted into a counterbored opening 71 in the corner piece 16*a*, has a threaded stem 76 which is threadedly engaged within a threaded socket formed in the opposite flange 15.

Comparing the positions of the headed bolt-like members in FIGS. 17 and 18, it can been that in FIG. 17 the heads 65 and 75 are spaced away from shoulders 78 and 79, respectively, that are formed within the counterbored openings 68 and 71 in the flange 15 and the corner piece 16*a*. FIG. 18 shows the open condition wherein the heads 65 and 67 bottom against the shoulders 78 and 79 to limit the amount of separation between the center piece and the adjacent wall flanges. The separation is sufficient to relieve the heavy pressure which grips the sand cake against the interior wall surfaces of the drag and permits the cake to easily slide downwardly relative to the cake for removal.

The opening and closing mechanism for the cope is illustrated in FIGS. 19 and 20 in closed and opened conditions respectively. Referring to FIG. 19, a flat, pancake-type cylinder 80, containing a flat piston 81, is secured upon one of the two adjacent wall flanges 15. Bolts 82 extend through opening 83 in the cylinder edge portions and threadedly engage within threaded sockets 84 in the flange 15. A bolt-like element having an enlarged head 86 fits within a socket 87 in the piston 81. Attached to the head 86 is a stem 88 which has a screw on its free end for fine adjustment of the stem length. The screw has a head 89 and a threaded stem 90 engaged within a threaded opening in the stem 88. The stem and the screw head 89 loosely fit through an opening 91 in the corner piece 16*a* and an opening 92 in the flange 15. Actuation of the piston by pressurized fluid entering through the hydraulic line 85 moves the piston towards the flange 15, upon which its cylinder is mounted, causing the screw head 89 to push against the opposite flange 15 for forcing the two flanges apart. That condition is illustrated in FIG. 20 where the arrow on the stem 88 indicates the stem endwise movement which separates the flanges 15.

The mechanism includes a closing cylinder containing a flat movable piston 96. The cylinder 95, which is a flat, pancake-type of cylinder, is secured by elongated headed screws 97 to the opposite flange by means of a threaded screw connection 98 within a threaded socket in the opposite flange. Each stem 99 of the screws 97 loosely extends through an opening 102 in the cylinder body, an opening 101 in its adjacent flange 15 and an opening 100 in the corner piece 16*a*. When the piston 96 is actuated to press against its adjacent flange portion by means of pressurized fluid delivered to the cylinder through a fluid line 105, it causes the wall portion or flange against which it presses to move tightly against the center piece 16*a*. Meanwhile, it draws the opposite flange 15 against the center piece 16*a* by means of the elongated screws 97 due to the movement of the cylinder 95 relative to the piston.

In order to limit the amount of separation of the flanges 15 from the center piece 16*a*, separate limit devices are provided. For the flange upon which the cylinder 80 is mounted, a headed bolt-like element 109 is provided. This has a head fitted within a bore 110 and a stem 111 threadedly engaged within a threaded socket in the corner piece. The head bottoms against the bottom of the bore 110 to act as a stop, as illustrated in FIG. 20. Alternatively, it is spaced from the bottom of the bore, as illustrated in FIG. 19, when the flange and the corner piece are abutted.

A similar kind of stop is provided for the flange upon which the cylinder 95 is mounted. Here, the headed, bolt-like element 115 has its head fitted within a socket 116 and its stem 117 is threadedly engaged within a threaded opening 118 in the corner piece. The head is spaced from the bottom of the bore 116 when the flange is abutted against the corner piece. However, when the corner piece and flange are separated, as in FIG. 20, the head bottoms against the bottom of the bore 116.

The contact between the heads of the bolt-like stops, and the bottoms of the bores within which they fit, limit the gap or spacing to predetermined amounts. By way of example, the spacings may be limited to about 0.030 inches each, which is sufficient spacing to permit the walls of the cope to release the sand cake and permit removal of the cake. Of course, the amount of spacing can be varied considerably, depending upon the amount of separation required for the particular sand cake and flask.

In order to guide and prevent cocking movement of the cope walls relative to the center piece, a dowel pin 119 may be provided. The dowel is fitted within aligned openings 120 and 121 in the flanges and center piece, respectively. The number of dowels is dependent upon the amount of guiding needed for a particular flask. Similar dowels may be used in the drag frame section.

In operating the opening and closing mechanisms for each of the cope and drag, suitable valves and fluid pressure sources may be provided (not illustrated) to provide the necessary pressurized fluid at the required times. The application of the pressurized fluid may be cycled so that the entire sequence of forming the cake, as described above, may be automatically performed within a machine following preselected time cycles.

Having fully described an operative embodiment of this invention, we now claim:

1. A method for forming a flaskless sand cavity casting cake having a drag portion and a cope portion with a pattern in a flask formed of aligned cope and drag frame sections, comprising the steps of:

(a) forming the drag portion of the cake by positioning the drag frame section upon a substantially horizontal support plate upon which a drag pattern half is arranged, filling it with sand, covering the sand filling with a cover board and then inverting the drag frame section;

(b) forming the cope portion of the cake by positioning the cope frame section upon the drag frame section in alignment therewith and surrounding a cope pattern half and filling the cope section with sand;

(c) applying a considerable pressure against the upper surface of the sand filling in the cope and the lower surface of the sand filling in the drag to compact the sand therebetween to form a relatively hard sand cake which is tightly wedged against the interior walls of the cope and drag frame sections;

(d) next, forming an open casting cavity by temporarily removing the cope from the drag and then removing the pattern halves and repositioning the cope upon the drag for aligning the cope and drag cavity halves formed therein;

(e) laterally expanding both of the cope and drag frame sections by temporarily separating adjacent wall portions of each of said sections at preselected locations in the walls such that said sections move substantially equidistantly from said cope and drag portions of the cake defining the sections sufficiently to release the cake from the frame section walls of both the cope and the drag frame sections;

(f) relatively moving the released cake and flask for removing the sand cake out of the flask for subsequent casting of molten metal in the sand cake cavity.

2. A method as defined in claim 1, and wherein the sand cake is removed from the flask by moving the cake downwardly relative to the complete flask formed of the aligned cope and drag frame sections so that the complete sand cake is removed out of the bottom of the drag.

3. A method as defined in claim 1, and including expanding the drag frame section by laterally separating opposite corners of the frame to provide gaps at such corners so that the opposed walls defining the frame are moved apart relative to each other for releasing the sand cake.

4. A method as defined in claim 3, and wherein the inner surfaces of the walls defining the frames are slightly sloped in an inward and upward direction from the bottom of the drag to the top of the cope;

and including the cake being moved downwardly out of the bottom of the drag frame for removal from the flask.

* * * * *